United States Patent [19]

Seoka et al.

[11] 4,288,532

[45] Sep. 8, 1981

[54] COLOR PHOTOGRAPHIC MATERIALS CONTAINING CYAN COLOR-FORMING COUPLERS

[75] Inventors: Yoshio Seoka; Kozo Aoki; Yukio Yokota; Seiiti Kubodera, all of Minami-ashigara, Japan

[73] Assignee: Fuji Photo Film Co., Ltd., Minami-ashigara, Japan

[21] Appl. No.: 120,962

[22] Filed: Feb. 13, 1980

[30] Foreign Application Priority Data

Feb. 13, 1979 [JP] Japan ..... 54/15885

[51] Int. Cl.[3] ..... G03C 7/00; G03C 1/40

[52] U.S. Cl. ..... 430/385; 430/505; 430/553

[58] Field of Search ..... 430/553, 552, 385, 503, 430/505

[56] References Cited

U.S. PATENT DOCUMENTS

| | | | |
|---|---|---|---|
| 3,002,836 | 10/1961 | Vittum et al. | 430/552 |
| 3,767,411 | 10/1973 | Kishimoto et al. | 430/553 |
| 3,839,044 | 10/1974 | Salminen et al. | 430/553 |
| 4,072,525 | 2/1978 | Inouye et al. | 430/385 |
| 4,134,766 | 1/1979 | Kikuchi et al. | 430/553 |

*Primary Examiner*—Travis Brown, Jr.

*Attorney, Agent, or Firm*—Sughrue, Rothwell, Mion, Zinn and Macpeak

[57] ABSTRACT

A silver halide color photographic light-sensitive material comprising a support having thereon at least one silver halide emulsion layer, said photographic light-sensitive material containing at least one cyan color-forming coupler represented by the following general formula (I):

(I)

wherein l represents 0, 1 or 2; X represents a group capable of being released upon the coupling reaction and having at least 6 carbon atoms; Y represents RCONH—, RNHCO— or RNHCONH— wherein R represents a hydrogen atom, a methyl group, an ethyl group or a methyl group substituted with one or more halogen atoms; n represents 1 or 2 and Y may be the same or different when n is 2; and the phenyl group can be substituted with a halogen atom, an alkyl group having 1 to 3 carbon atoms or an alkoxy group having 1 to 3 carbon atoms. The dyes formed from the cyan color-forming couplers have unusually good spectral absorption properties and exceptional fastness to light and heat.

9 Claims, No Drawings

COLOR PHOTOGRAPHIC MATERIALS CONTAINING CYAN COLOR-FORMING COUPLERS

BACKGROUND OF THE INVENTION

1. Field of the Invention

The present invention relates to a cyan coupler which can be incorporated into photographic light-sensitive materials and produce a dye image having excellent fastness.

2. Description of the Prior Art

Couplers that are used in color photographic light-sensitive materials should form dye images having excellent fastness. N-(2'-Acetamido-β-phenylethyl)-1-hydroxy-2-naphthamide produces a dye image having good fastness by coupling reaction and good spectral absorption properties for cyan color images and is disclosed in U.S. Pat. No. 3,002,836. However, this compound cannot be incorporated into a color photographic light-sensitive material since it does not have the so-called diffusion-resistant group in its molecule. Attempts have been made to introduce a diffusion-resistant group into its molecule, however, when an alkyl group having a large number of carbon atoms is introduced to N-(alkylcarbonylamino-, alkylcarbamyl- or alkylcarbamylamino-substituted phenylalkyl)-1-hydroxy-2-naphthamide type cyan couplers including N-(2'-acetamido-β-phenylethyl)-1-hydroxy-2-naphthamide in order to render them diffusion-resistant, the fastness of dye images formed from these couplers by coupling reaction becomes remarkably worse depending on the position at which the diffusion-resistant group is introduced. In accordance with the present invention, an alkyl group having a large number of carbon atoms is introduced at a position without the accompanying degradation of the fastness of the dye images.

SUMMARY OF THE INVENTION

An object of the present invention is to provide a cyan coupler which can be incorporated into a photographic light-sensitive material and produces a dye having superior spectral absorption properties for a cyan dye and excellent fastness.

Another object of the present invention is to provide a color photographic light-sensitive material containing such a cyan coupler.

Another object of the present invention is to provide a color photographic light-sensitive material which provides color images which are less turbid and have excellent fastness.

These and other objects of the present invention are accomplished with a cyan coupler in which an alkyl group having a large number of carbon atoms is introduced in a coupling-off group thereof and which is represented by the following general formula (I):

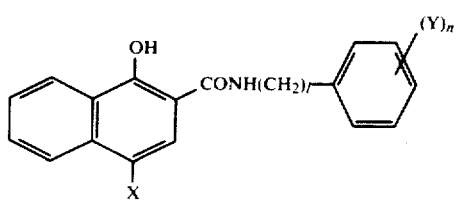

(I)

wherein l represents 0, 1 or 2; X represents a group capable of being released upon the coupling reaction (hereinafter referred to as coupling-off group) and having at least 6 carbon atoms; Y represents a group of RCONH—, RNHCO— or RNHCONH— (wherein R represents a hydrogen atom, a methyl group, an ethyl group or a methyl group substituted with one or more halogen atoms (for example, a chlorine atom or a bromine atom); n represents 1 or 2 and Y may be the same or different when n is 2; and the phenyl group can be substituted with a halogen atom, an alkyl group having 1 to 3 carbon atoms or an alkoxy group having 1 to 3 carbon atoms.

DETAILED DESCRIPTION OF THE INVENTION

The effects according to the present invention are particularly remarkable when X represents a coupling-off group having at least 6 carbon atoms and an alkali-solubilizing group (for example, a —COOM or —$SO_3M$ group wherein M represents a hydrogen atom or an alkali metal atom, e.g., a lithium atom, a sodium atom or a potassium atom) in the general formula (I). Further X groups in which the connecting portion is an oxygen atom are preferred, and groups having an alkali-solubilizing group and having 6 to 50 carbon atoms such as those represented by the following general formula (II) are particularly preferred.

$$-O-(B)_a-(L_1-D)_b-L_2 \qquad \text{(II)}$$

wherein $L_1$ represents a straight chain or branched chain alkylene group having 1 to 12 carbon atoms which may be substituted or a phenylene group having 6 to 12 carbon atoms which may be substituted; $L_2$ represents a hydrogen atom, a straight chain, branched chain or cyclic alkyl group having 8 to 22 carbon atoms which may be substituted or a phenyl group which may be substituted; b represents 0, 1 or 2; D represents a divalent connecting group (for example, —O—, —NH—, —S—, —NECO—, —CONE—,

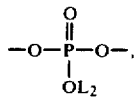

—$CO_2$—, —$NESO_2$— or —$SO_2NE$— wherein E represents a hydrogen atom, a straight chain, branched chain or cyclic alkyl group having 1 to 8 carbon atoms which may be substituted or a phenyl group which may be substituted); B represents a divalent or trivalent group represented by —CO—, —$CO_2$—, —$SO_2$— or

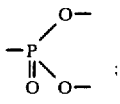

and a represents 0 or 1; and when a represents 1 and B represents a trivalent group, another —$(L_1\text{-}D)_b$—$L_2$ group can be substituted. Suitable substituents for the alkylene group or the alkyl ($L_2$) group contain a carboxy group, a sulfoxy group, a carboxyalkyl group the alkyl moiety of which has 1 to 5 carbon atoms (for example, —$CH_2COOH$) or a sulfoalkyl group the alkyl moiety of which has 1 to 5 carbon atoms (for example, $-CH_2SO_3H$).
Specific examples of X represented by the general formula (II) are illustrated below.
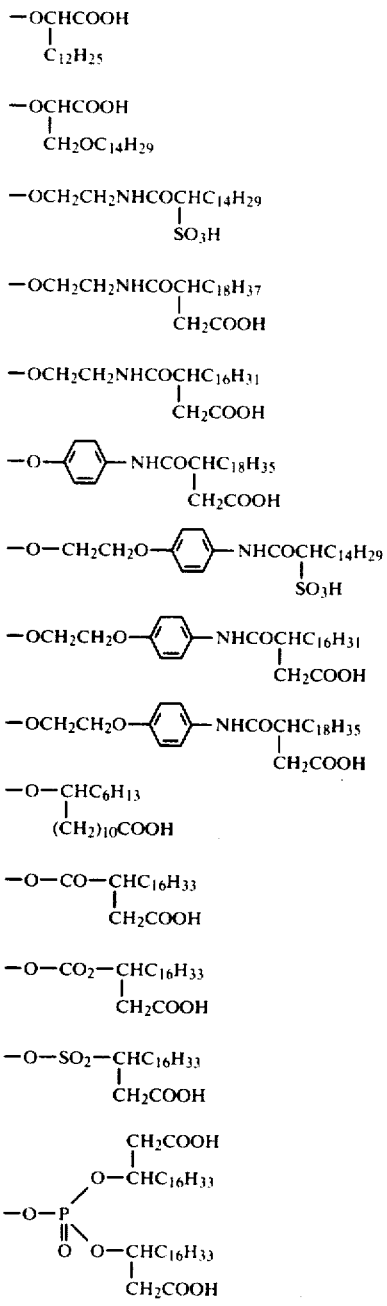
Specific examples of the cyan couplers according to the present invention are illustrated below.
Coupler (1)
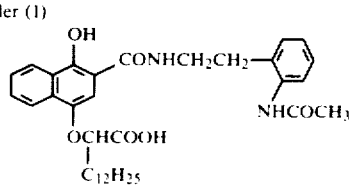
Coupler (2)
-continued
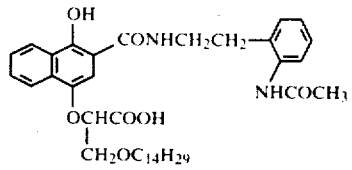
Coupler (3)
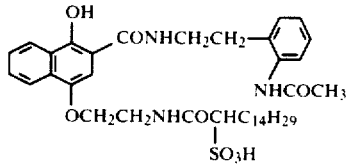
Coupler (4)
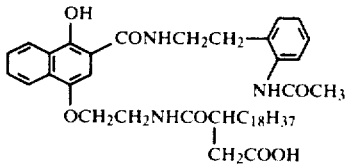
Coupler (5)
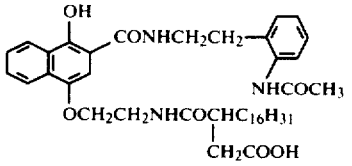
Coupler (6)
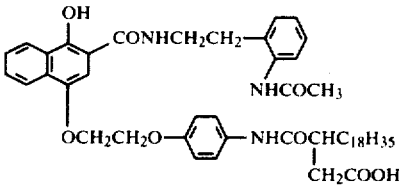
Coupler (7)
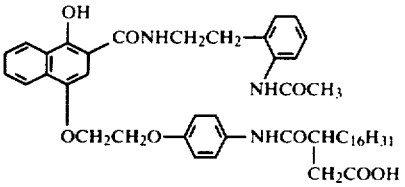
Coupler (8)
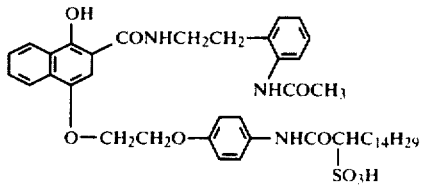
Coupler (9)
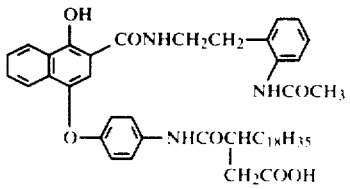
Coupler (10)

-continued
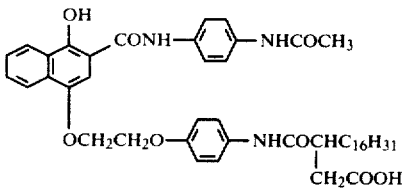
Coupler (11)
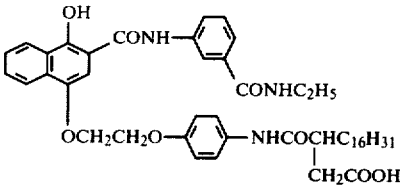
Coupler (12)
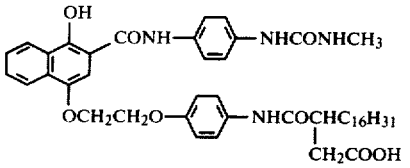
Coupler (13)
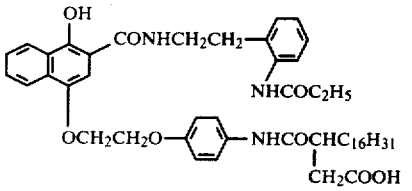
Coupler (14)
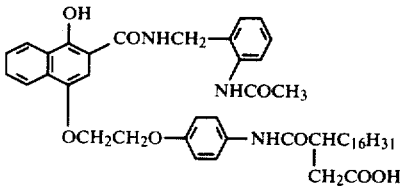
Coupler (15)
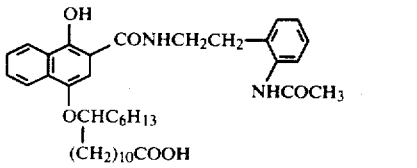
Coupler (16)
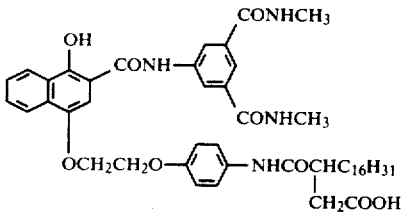
Coupler (17)
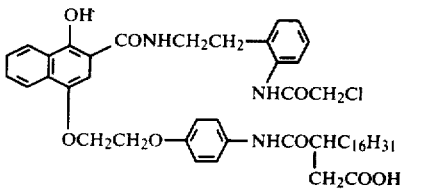
Coupler (18)
-continued
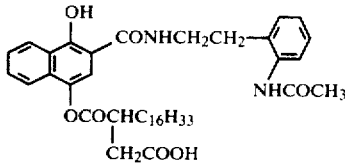
Coupler (19)
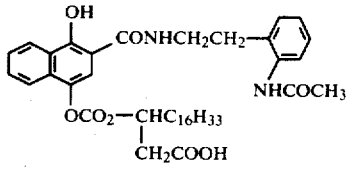
Coupler (20)
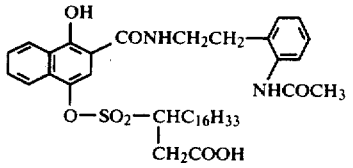
Coupler (21)
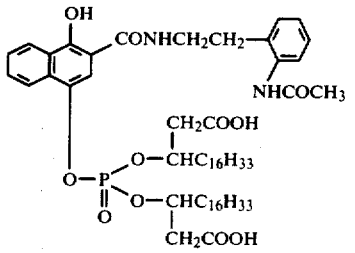
The couplers according to the present invention can generally be synthesized by the following methods.
The first method is shown in the following general formula:
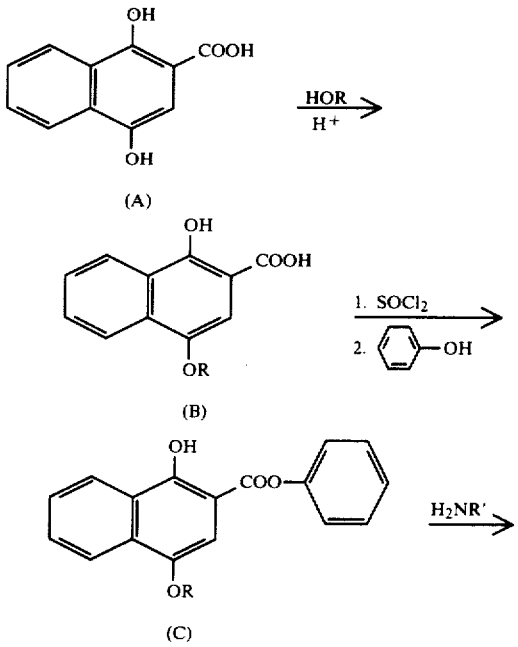

-continued

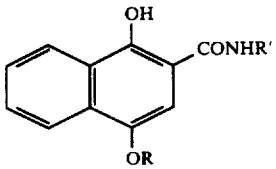

(D)

That is, 1,4-dihydroxynaphthoic acid (A) and an alcohol (for example, ethanolamine, p-nitrophenoxyethanol, 12-hydroxystearic acid, etc.) are condensed (dehydration) by heating at about 60° to about 160° C. in the absence of a solvent or in an inert solvent such as toluene in the presence of an acid catalyst (for example, sulfuric acid, hydrochloric acid, p-toluene sulfonic acid, etc.) to prepare the corresponding 4-ether compound (B). The compound (B) is treated with thionyl chloride (for example, refluxed in benzene) to convert to the acid chloride which is then reacted with a phenol (for example, refluxed in benzene) to prepare a phenyl ester (C). The compound (C) is condensed with an amine (for example, reacted at a temperature from room temperature to about 180° C. in the absence of a solvent or in an appropriate solvent such as an alcohol, tetrahydrofuran, dimethylformamide, etc.) to prepare a coupler (D). When ethanolamine or p-nitrophenoxy ethanol is condensed with Compound (A), the corresponding amino compound is reacted with a succinic anhydride derivative (for example, octadecenyl succinic anhydride (OSA), etc.) after the step forming (B) or (D) to prepare a desired coupler.

A second method is shown in the following general formula:

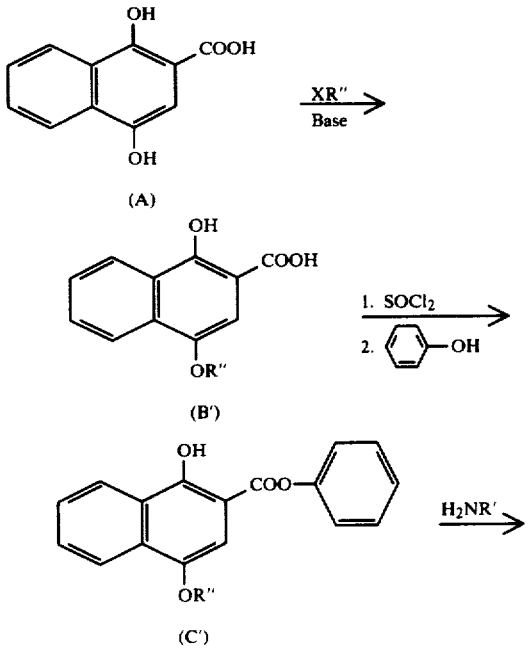

-continued

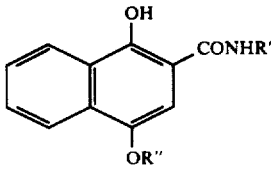

(D')

That is, 1,4-dihydroxynaphthoic acid (A) and a halide (for example, ethyl α-bromomyristate, p-fluoronitrobenzene, etc.) are reacted in a solvent (for example, water, an alcohol, dimethylformamide, etc.) in the presence of a base (for example, sodium hydroxide, sodium methoxide, sodium hydride, etc.) to prepare a compound (B'). By carrying out the procedures described in the first method above using the compound (B') a coupler (D') is prepared.

Specific synthesis examples of the couplers are illustrated below.

Synthesis Example of Coupler (6)

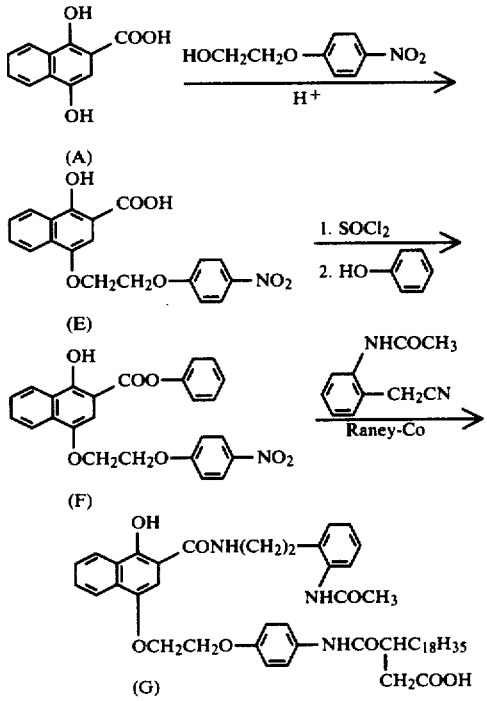

REACTION OF 1,4-DIHYDROXYNAPHTHOIC ACID (A) WITH P-NITROPHENOXYETHANOL

Synthesis of Compound (E)

To 1,4-dihydroxynaphthoic acid (A), an excess amount of p-nitrophenoxyethanol and sulfuric acid were added and the mixture was heated on a steam bath for 3 hours. After cooling, the crystals formed were collected by filtration and washed with alcohol to obtain Compound (E).

Synthesis of Compound (F)

Compound (E) was boiled in benzene together with an excess amount of thionyl chloride to convert the corresponding acid chloride. The latter was reacted with phenol by boiling in benzene to obtain Compound (F) quantitatively.

Synthesis of Compound (G)

Compound (F) and 1.2 equivalents of o-acetylaminobenzylnitrile were hydrogenated in an autoclave (pressure of hydrogen: 25 kg/cm$^2$, at 100° C.) in tert-butanol in the presence of Raney cobalt catalyst. After removing the catalyst, the solvent was substituted with acetonitrile to obtain Compound (G), m.p. 185° to 187° C., yield 45%.

Synthesis of Coupler (6)

Compound (G) and 1-equivalent of octadecenyl succinic anhydride were stirred in acetonitrile at 50° C. for 3 hours. The precipitate was collected by filtration and recrystallized from acetonitrile to obtain Coupler (6), m.p. 183° to 186° C., yield 60%.

Synthesis Example of Coupler (1)

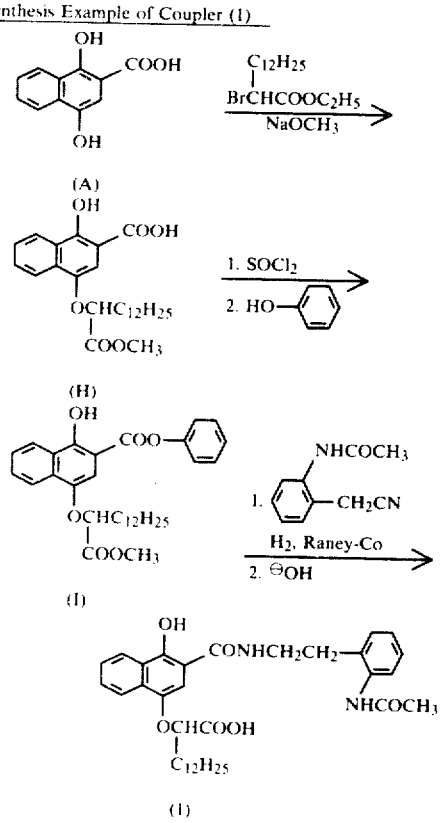

Synthesis of Compound (H)

1,4-Dihydroxynaphthoic acid (A) was dissolved in dimethylformamide and to the solution 2-equivalent of sodium methylate was added under nitrogen atmosphere. To the reaction mixture, 1-equivalent of ethyl α-bromomyristate was added dropwise and the mixture was stirred for 2 hours. The mixture was poured into ice water together with an excess amount of hydrochloric acid and the crystals deposited were collected by filtration and dried to obtain Compound (H), yield 90%.

Synthesis of Compound (I)

Compound (H) was boiled in benzene together with an excess amount of thionyl chloride to convert the corresponding acid chloride. The latter was reacted with phenol by boiling in benzene to obtain Compound (I) quantitatively.

Synthesis of Coupler (1)

Compound (I) and 1.2 equivalents of o-acetylaminobenzylnitrile were hydrogenated in an autoclave (pressure of hydrogen: 45 kg/cm$^2$, at 100° C.) in tert-butanol in the presence of Raney cobalt catalyst. After removing the catalyst, to the residue, ethanol and an excess amount of an aqueous sodium hydroxide solution were added and the mixture was stirred at room temperature for 4 hours. The reaction mixture was acidified by the addition of hydrochloric acid and the crystals deposited were collected and recrystallized from ethanol to obtain Coupler (1), m.p. 210° to 212° C., yield 70%.

Synthesis Example of Coupler (10)

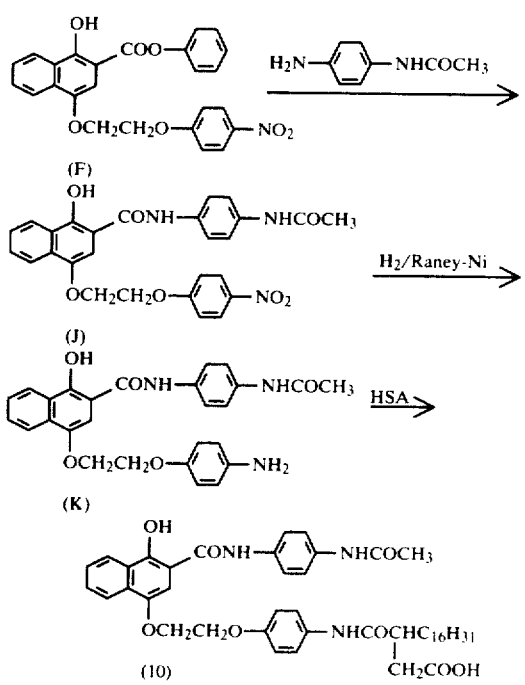

Synthesis of Compound (J)

Compound (F) described in Synthesis Example of Coupler (6) and 1-equivalent of p-acetylaminoaniline was heated at 160° C. under reduced pressure for 2 hours. The oily product was poured into acetonitrile and the crystals deposited were collected by filtration to obtain Compound (J), yield 90%.

Synthesis of Coupler (10)

Compound (J) was hydrogenated (pressure of hydrogen: 30 kg/cm$^2$, at 50° C.) in ethanol in the presence of Raney nickel catalyst. After removing the catalyst, the solvent was removed under reduced pressure. The residue was suspended in acetonitrile, 1-equivalent of hexadecenyl succinic anhydride (HSA) was added to the suspension and the mixture was stirred at 50° C. for 4 hours. The precipitate was collected by filtration and recrystallized from methanol to obtain Coupler (10), m.p. 183° to 185.5° C., yield 45%.

In the production of the color photographic light-sensitive material according to the present invention, known couplers other than the cyan couplers are also generally used. Non-diffusible couplers which contain a hydrophobic group, called a ballast group, in the molecule thereof are preferred as couplers. Couplers can be 4-equivalent or 2-equivalent couplers. In addition, colored couplers providing a color correction effect or couplers which release development inhibitors upon development (the so-called DIR couplers) can also be present therein. Also, couplers which provide a colorless product on coupling can be employed.

Conventional open chain ketomethylene type couplers can be employed as yellow forming couplers. Of these couplers, benzoyl acetanilide type and pivaloyl acetanilide type compounds are especially effective. Specific examples of yellow forming couplers which can be employed are described, for example, in U.S. Pat. Nos. 2,875,057, 3,265,506, 3,408,194, 3,551,155, 3,582,322, 3,725,072 and 3,891,445, German Pat. No. 1,547,868, German patent application (OLS) Nos. 2,219,917, 2,261,361 and 2,414,006, British Pat. No. 1,425,020, Japanese Pat. No. 10783/76, Japanese patent applicatin (OPI) Nos. 26133/72 (The term "OPI" as used herein refers to a "published unexamined Japanese patent application"), Nos. 73147/73, 102636/76, 6341/75, 123342/75, 130442/75, 21827/76 and 87650/75, etc.

Pyrazolone type compounds, indazolone type compounds, cyanoacetyl compounds, etc., can be employed as magenta couplers and particularly preferred couplers are pyrazolone type compounds. Specific examples of magenta color forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German patent application (OLS) Nos. 2,408,665, 2,417,945, 2,418,959 and 2,424,467, Japanese Pat. Nos. 6031/65 and 45990/76, Japanese patent application (OPI) Nos. 20826/76, 58922/77, 129538/74, 74027/74, 159336/75, 42121/77, 74028/74, 60233/75 and 26541/76, etc.

Colored couplers which can be employed are those described, for example, in U.S. Pat. Nos. 3,476,560, 2,521,908, 3,034,892, Japanese Pat. Nos. 2016/69, 22335/63, 11304/67 and 32461/69, Japanese patent application (OPI) Nos. 26034/76 and 42121/77, German patent application (OLS) No. 2,418,959, etc.

DIR couplers which can be employed are those described, for example, in U.S. Pat. Nos. 3,227,554, 3,617,291, 3,701,783, 3,790,384 and 3,632,345, German patent application (OLS) Nos. 2,414,006, 2,454,301 and 2,454,329, British Pat. No. 953,454, Japanese patent application (OPI) Nos. 69624/77 and 122335/74, Japanese Pat. No. 16141/76, etc.

In addition to DIR couplers, compounds which release development inhibitors upon development can also be present in the light-sensitive material. For example, those DIR compounds as described, for example, in U.S. Pat. Nos. 3,297,445 and 3,379,529, German patent application (OLS) No. 2,417,914, etc., can be employed.

Two or more kinds of the couplers described above can be incorporated in the same layer or the same coupler compound can also be present in two or more layers.

Conventional methods, e.g., the method described in U.S. Pat. No. 2,322,027, can be employed to incorporate the cyan couplers according to the present invention and the above-described couplers into the silver halide emulsion layers. For example, the couplers can be dissolved in phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate), citric acid esters (e.g., tributyl acetylcitrate), benzoic acid esters (e.g., octyl benzoate), alkyl amides (e.g., diethyl laurylamide), etc., or organic solvents having a boiling point of about 30° to about 150° C., e.g., lower alkyl acetates such as ethyl acetate, butyl acetate, ethyl propionate, sec-butyl alcohol, methyl isobutyl ketone, $\beta$-ethoxyethyl acetate, methyl Cellosolve acetate, etc., and the resulting solutions dispersed in a hydrophilic colloid. The high boiling point organic solvents and low boiling point organic solvents described above can also be employed as a mixture thereof.

Where the couplers have acid groups such as a carboxylic acid group or a sulfonic acid group, they can be incorporated into the hydrophilic colloid as an alkaline aqueous solution thereof. In this case the couplers are dispersed in the following manner.

First, the couplers are dissolved in a solution of an alkali metal hydroxide (such as sodium hydroxide, alcohol-potassium hydroxide, etc.) in water or a mixture of water and alcohol. The mixture is directly incorporated, or the mixture is mixed with a hydrophilic colloid composition to obtain a colloidal solution, then the colloidal solution is incorporated into a photographic emulsion. At this juncture, generally a neutralization agent in an amount necessary to neutralize the alkali is previously added to the photographic emulsion or the hydrophilic colloid component, or the neutralization agent is added to the emulsion or colloid after adding the coupler solution. A suitable neutralization agent is an acid such as a mineral acid, an organic acid, etc. Gelatin, hydrophilic colloids described above used as a vehicle for a silver halide, water-soluble colloidal materials having a carboxyl group and a mixture thereof, particularly preferably, gelatin can be used as the hydrophilic colloid component used for dispersing the couplers.

The couplers are incorporated into the emulsion layers, generally in an amount of about $2\times10^{-3}$ mol to about $5\times10^{-1}$ mol, preferably $1\times10^{-2}$ mol to $5\times10^{-1}$ mol, per mol of silver.

The photographic emulsion used in the present invention may be spectrally sensitized with methine dyes, or the like. Suitable dyes include cyanine dyes, merocyanine dyes, complex cyanine dyes, complex merocyanine dyes, holopolar cyanine dyes, hemicyanine dyes, styryl dyes, hemioxonol dyes, etc. Particularly useful dyes are those belonging to cyanine dyes, merocyanine dyes, and complex merocyanine dyes. These dyes may contain as basic heterocyclic nucleus any of nuclei usually used for cyanine dyes, that is, there can be contained pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; nuclei wherein an aliphatic hydrocarbon ring or rings are fused to these nuclei; and nuclei wherein an aromatic hydrocarbon ring or rings are fused to these nuclei, i.e., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc. These nuclei may be susbtituted on the carbon atom or atoms thereof.

Merocyanine dyes or complex merocyanine dyes contain, as ketomethylene structure-containing nucleus, 5- to 6-membered heterocyclic nucleus such as a pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus, or the like.

Useful sensitizing dyes are described in, for example, German Pat. No. 929,080, U.S. Pat. Nos. 2,231,658, 2,493,748, 2,503,776, 2,519,001, 2,912,329, 3,656,959, 3,672,897, 3,694,217, British Pat. No. 1,242,588, Japanese Pat. No. 14030/69, etc.

These sensitizing dyes may be used alone or in combination. Combination of sensitizing dyes is often used for attaining, in particular, supersensitization. Typical examples thereof are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Pat. No. 1,344,281, Japanese Pat. No. 4936/68, etc.

Dyes which themselves do not show a spectrally sensitizing action or materials which do not substantially absorb visible light, showing supersensitivity, may be incorporated in the emulsion together with the sensitizing dyes. For example, aminostilbenes substituted by a nitrogen-containing heterocyclic group (for example, those described in U.S. Pat. No. 2,933,390 and 3,635,721), aromatic organic acid-formaldehyde condensates (for example, those described in U.S. Pat. No. 3,743,510), cadmium salts, azaindene compounds, etc., may be incorporated. Combinations described in U.S. Pat. Nos. 3,615,613, 3,615,641, 3,617,295, and 3,635,721 are particularly useful.

The hydrophilic colloid layers of the light-sensitive material prepared in accordance with the present invention can also contain ultraviolet absorbers. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese patent application (OPI) No. 2784/71), cinnamic acid ester compounds (e.g., those described in U.S. Pat. Nos. 3,707,375 and 3,705,805), or benzoxazole compounds (e.g., those described in U.S. Pat. No. 3,499,762) can be employed. Ultraviolet absorbing couplers (e.g., α-naphthol type cyan color forming couplers) or ultraviolet absorbing polymers can also be employed. These ultraviolet absorbents can also be mordanted in a specific layer(s), if desired.

The light-sensitive material of the present invention may contain hydroquinone derivatives, aminophenol derivatives, gallic acid derivatives, ascorbic acid derivatives, etc., as color fog preventing agents. Specific examples of these compounds are those described, for example, in U.S. Pat. Nos. 2,360,290, 2,336,327, 2,403,721, 2,418,613, 2,675,314, 2,701,197, 2,704,713, 2,728,659, 2,732,300 and 2,735,765, Japanese patent application (OPI) Nos. 92988/75, 92989/75, 93928/75 and 110337/75, Japanese Pat. No. 23813/75, etc.

Further, the photographic emulsion layers or other hydrophilic colloid layers of the light-sensitive material prepared in accordance with the present invention can contain a variety of known surface active agents for various purposes such as coating aids, preventing the formation of static charges, improving lubrication, improving emulsion-dispersion, preventing adhesion, improving the photographic properties (e.g., acceleration in development, enhanced contrast, sensitization), etc.

For example, nonionic surface active agents such as saponin (steroid type), alkylene oxide derivatives (e.g., polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides, polyethylene oxide adducts of silicones), glycidol derivatives (e.g., alkenylsuccinic acid polyglycerides, alkylphenol polyglycerides), fatty acid esters of polyvalent alcohols, alkyl esters of sucrose, urethanes or ethers thereof, etc.; anionic surface active agents containing an acid group such as a carboxyl group, a sulfo group, a phospho group, a sulfuric acid ester group, a phosphoric acid ester group, etc., such as triterpenoid type saponin, alkyl carbonates, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkyl polyoxyethylene alkylphenyl ethers, polyoxyethylene alkylphosphates, etc.; amphoteric surface active agents such as amino acids, aminoalkyl sulfonic acids, aminoalkyl sulfates or phosphates, alkyl betaines, amineimides, amine oxides, etc.; cationic surface active agents, e.g., alkylamine salts, aliphatic or aromatic quaternary ammonium salts, heterocyclic quaternary ammonium salts such as pyridinium or imidazolium, etc., phosphonium or sulfonium salts containing aliphatic or heterocyclic rings, etc., can be used.

Specific examples of these surface active agents are described in U.S. Pat. Nos. 2,240,472, 2,831,766, 3,158,484, 3,210,191, 3,294,540 and 3,507,660, British Pat. Nos. 1,012,495, 1,002,878, 1,179,290 and 1,198,450, Japanese patent application (OPI) No. 117414/75, U.S. Pat. Nos. 2,739,891, 2,823,123, 3,068,101, 3,415,649, 3,666,478 and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Pat. Nos. 378/65, 379/65 and 13822/68, U.S. Pat. Nos. 2,271,623, 2,288,226, 2,944,900, 3,253,919, 3,671,247, 3,772,021, 3,589,906, 3,666,478 and 3,754,924, German patent application (OLS) No. 1,961,638, Japanese patent application (OPI) No. 59025/75, etc.

The photographic emulsion layers or other hydrophilic colloid layers of the photographic light-sensitive material of the present invention can contain an inorganic or organic hardener. For example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloylhexahydro-s-triazine or bis(vinylsulfonyl)methyl ether), active halogen compounds (such as 2,4-dichloro-6-hydroxy-s-triazine), mucohalic acids (such as mucochloric acid or mucophenoxychloric acid), isooxazoles, dialdehyde starch, 2-chloro-6-hydroxytriazinylated gelatin and the like can be used individually or in combination. Specific examples of these compounds are described in, e.g., U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,664 and 3,543,292, British Pat. Nos. 676,628, 825,544 and 1,270,578, German Pat. Nos. 872,153 and 1,090,427, Japanese Pat. Nos. 7133/59 and 1872/71, etc.

The present invention is also applicable to multilayer multi-color photographic materials containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied optionally as desired. Ordinarily, a cyan forming coupler is present in a red-sensitive emulsion layer, a magenta forming coupler is present in a green-sensitive emulsion layer and a yellow forming coupler is present in a blue-sensitive emulsion layer, respectively. However, if necessary, a different combination can be employed.

In the photographic light-sensitive material of the present invention, the photographic emulsion layers or other hydrophilic colloid layers are coated onto a flexible support such as a synthetic resin film, a paper, cloth, etc., or onto rigid supports such as glass, ceramics, metals, etc., which are conventionally employed for photographic light-sensitive materials.

Useful flexible supports are films of semisynthetic or synthetic high molecular weight materials such as cellulose nitrate, cellulose acetate, cellulose acetate butyrate, polystyrene, polyvinyl chloride, polyethylene terephthalate, polycarbonate, etc.; or paper on which a baryta layer or an α-olefin polymer (e.g., polyethylene, polypropylene, ethylene/butene copolymers), etc., is coated or laminated. These supports can also be colored using dyes or pigments and, further, blackened for the purpose of shielding light. The surface of these supports is generally subjected to a subbing treatment in order to improve the adhesion to photographic emulsion layers or the like. The support surface can also be subjected to a corona discharge treatment, an ultraviolet light irradiation treatment or a flame treatment, prior to or after the subbing treatment.

The photographic emulsion used in this invention can be prepared using the methods described in, e.g., P. Grafkides, *Chimie et Physique Photographique,* Paul Montel, Paris (1967), G. F. Duffin, *Photographic Emulsion Chemistry,* The Focal Press, London (1966), V. L. Zelikman et al., *Making and Coating Photographic Emulsions,* The Focal Press, London (1964), etc. That is, any of the acid method, the neutral method, the ammonia method and other methods can be used. Moreover, the reaction of a soluble silver salt with a soluble halogen salt can be made using any of the single jet method, the double jet method and a combination thereof.

The method in which grains are formed in the presence of an excess of silver ions (the so-called reverse mixing method) can also be used. As one of the modes of the double jet method, the method in which the pAg of the liquid phase in which the silver halide is to be produced is kept constant, that is, the so-called controlled double jet method, can be used. This method can provide silver halide emulsions having a regular crystal form and an almost uniform grain size.

Two or more of silver halide emulsions which are separately prepared can be mixed and then used.

In the process of the formation of silver halide grains or physical ripening, cadmium salts, zinc salts, lead salts, thallium salts, iridium salts or complex salts thereof, rhodium salts or complex salts thereof, iron salts or iron complex salts, and the like can be present.

It is advantageous in the present invention to employ gelatin as a binder or a protective colloid for the photographic emulsion in the present invention, but other hydrophilic colloids can also be employed. For example, gelatin derivatives, graft polymers of gelatin and other high molecular weight materials; proteins such as albumin, casein, etc.; cellulose derivatives such as hydroxyethyl cellulose, carboxymethyl cellulose, cellulose sulfate, etc.; saccharide derivatives such as sodium alginate, starch derivatives, etc.; a variety of synthetic hydrophilic high molecular weight materials such as homopolymers or copolymers such as polyvinyl alcohol, polyvinyl alcohol-partial acetal, poly-N-vinylpyrrolidone, polyacrylic acid, polymethacrylic acid, polyacrylamide, polyvinylimidazole, polyvinylpyrazole, etc., can be employed.

In addition to lime-processed gelatin, acid-processed gelatin or enzyme-processed gelatin as described in *Bull. Soc. Sci. Photo. Japan,* No. 16, page 30 (1966) can be used as the gelatin and, further, gelatin hydrolysates as well as enzyme-decomposed gelatin can similarly be used. Suitable gelatin derivatives which can be employed are those obtained by reacting, with gelatin, a variety of compounds such as acid halides, acid anhydrides, isocyanates, bromoacetic acid, alkane sultones, vinylsulfonamides, maleic imide compounds, polyalkylene oxides, epoxy compounds, etc. Specific examples of these compounds are described in, for example, U.S. Pat. Nos. 2,614,928, 3,132,945, 3,186,846, and 3,312,553, British Pat. Nos. 861,414, 1,033,189 and 1,005,784, Japanese Pat. No. 26845/67, etc.

Suitable gelatin-graft polymers which can be employed are those obtained by grafting homopolymers or copolymers of vinyl monomers such as acrylic acid, methacrylic acid, derivatives thereof such as the esters, amides, etc., thereof, acrylonitrile, styrene, etc., to gelatin. In particular, graft polymers of gelatin with polymers which are compatible with gelatin to some extent, e.g., polymers of acrylic acid, methacrylic acid, acrylamide, methacrylamide, hydroxyalkyl methacrylates, etc., are preferred. Examples of these graft polymers are described in U.S. Pat. Nos. 2,763,625, 2,831,767, 2,956,884, etc.

Typical synthetic hydrophilic high molecular materials are described, for example, in German patent application (OLS) No. 2,312,708, U.S. Pat. Nos. 3,620,751 and 3,879,205, Japanese Pat. No. 7561/68, etc.

Any conventional photographic processing methods can be used for processing the light-sensitive material of the present invention. Known processing solutions can be used. The processing temperature can be between about 18° C. and about 50° C., in general, but a temperature lower than 18° C. or exceeding 50° C. can be used.

Conventional fixing solutions can be employed. In addition to thiosulfates and thiocyanates, organic sulfur compounds known as fixing agents can be employed as fixing agents. The fixing solutions can also contain water-soluble aluminum salts as hardening agents.

Conventional methods of forming color images can be used. For example, a nega-posi method (e.g., as described in *Journal of the Society of Motion Picture and Television Engineers,* Vol. 61, pages 667–701 (1953)), a color reversal method which comprises developing with a developer containing a black-and-white developing agent to form a negative silver image, then subjecting the photographic material to at least one uniform exposure or to another appropriate fogging treatment, and subsequently performing color development to obtain positive dye images; a silver dye bleaching method which comprises exposing a dye-containing photographic emulsion layer and developing the same to form a silver image and then bleaching the dyes using the silver image as a bleaching catalyst; etc., can be employed.

A color developer generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, those developing agents described in L. F. A. Mason, *Photographic Processing Chemistry*, pages 226–229, Focal Press (1966), U.S. Pat. Nos. 2,193,015 and 2,592,364, Japanese patent application (OPI) No. 64933/73, etc., can be employed.

The color developers can also contain pH buffering agents such as sulfites, carbonates, borates and phosphates of alkali metals, developing inhibitors or antifogging agents such as bromides, iodides or organic antifogging agents, etc. In addition, if desired, the color developers can also contain water softeners, preservatives such as hydroxylamine; organic solvents such as benzyl alcohol, diethylene glycol, etc.; developing accelerators such as polyethylene glycol, quaternary ammonium salts, amines; dye forming couplers; competing couplers; fogging agents such as sodium borohydride; auxiliary developers such as 1-phenyl-3-pyrazolidone; viscosity-imparting agents; polycarboxylic acid type chelating agents described in U.S. Pat. No. 4,083,723; antioxidants described in German patent application (OLS) No. 2,622,950, etc.

The photographic emulsion layers after color development are generally bleach-processed. Bleach processing can be performed at the same time as fixing or separately therefrom. Suitable bleaching agents which can be employed are compounds of polyvalent metals such as iron (III), cobalt (III), chromium (IV), copper (II), etc., peracids, quinones, nitroso compounds, etc. Specific examples include ferricyanides; bichromates; organic complexes of iron (III) or cobalt (III); aminopolycarboxylic acids such as ethylenediaminetetraacetic acid, nitrilotriacetic acid, 1,3-diamino-2-propanol tetraacetic acid, etc.; complexes of organic acids such as citric acid, tartaric acid, malic acid, etc.; persulfates; permanganates; nitrosophenol; etc. Of these, particularly useful bleaching agents are potassium ferricyanide, sodium ethylenediaminetetraacetate iron (III) and ammonium ethylenediaminetetraacetate iron (III). Ethylenediaminetetraacetate iron (III) complex is useful both in a bleaching solution and in a mono bath bleach-fixing solution.

Bleaching and bleach-fixing solutions can contain various additives including bleach accelerating agents as described in U.S. Pat. Nos. 3,042,520 and 3,241,966, Japanese Pat. Nos. 8506/70 and 8836/70, thiol compounds as described in Japanese patent application (OPI) No. 65732/78, etc.

The present invention is explained in greater detail with reference to the example below.

EXAMPLE

The following silver halide emulsion (A) was coated on a cellulose triacetate support having a subbing layer at a silver coverage of 0.50 g/m$^2$ and a protective layer was formed on the emulsion layer to provide sample [A].

Silver halide emulsion (A):

3,000 ml of a 0.5% aqueous sodium hydroxide solution containing 100 g of comparison cyan coupler (a) was added to 1 kg of a red-sensitive silver chlorobromide emulsion (containing 50 g of silver, 60 g of gelatin, and 30 mol% chloride) containing citric acid in the amount sufficient to almost neutralize the pH of the emulsion after the addition of the coupler solution to prepare a silver halide emulsion (A).

Comparison cyan coupler (a):

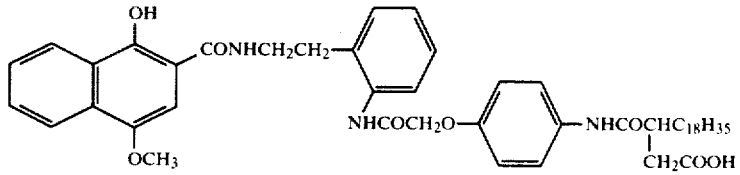

The protective layer was formed by applying an aqueous 5% gelatin solution on the silver halide emulsion layer at a dry thickness of 1 micron.

Furthermore, silver halide emulsions (B), (C), (D) and (E) were prepared by the same manner as the case of preparing the silver halide emulsion (A) using, however, the cyan couplers shown below, respectively, in an equimolar amount to the cyan coupler in the silver halide emulsion (A). Then Samples [B], [C], [D] and [E] were prepared by the same manner as the case of Sample [A] using these silver halide emulsions.

| Silver Halide Emulsion | Cyan Coupler Used |
|---|---|
| (B) | (6) |
| (C) | (1) |
| (D) | (10) |
| (E) | (11) |

Each of Samples [A] to [E] described above was exposed through a continuous wedge to white light and processed by the following processing steps at 38° C.

| | |
|---|---|
| 1. Color Development | 3 min 15 sec |
| 2. Bleach | 6 min 30 sec |
| 3. Wash | 3 min 15 sec |
| 4. Fix | 6 min 30 sec |
| 5. Wash | 3 min 15 sec |
| 6. Stabilization | 3 min 15 sec |

The compositions of the processing solutions used in the above processing were as follows:

Color Developer:

| | |
|---|---|
| Sodium Nitrotriacetate | 1.0 g |
| Sodium Sulfite | 4.0 g |

-continued

| | |
|---|---|
| Sodium Carbonate | 30.0 g |
| Potassium Bromide | 1.4 g |
| Hydroxylamine Sulfate | 2.4 g |
| 4-(N-Ethyl-N-β-methylsulfonamidoethyl-amino)-2-methyl-aniline Sulfate | 4.5 g |
| Water to make | 1 l |

Bleach Solution:

| | |
|---|---|
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 l |

Fix Solution:

| | |
|---|---|
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 l |

Stabilization Solution:

| | |
|---|---|
| Formalin | 8.0 ml |
| Water to make | 1 l |

These samples thus processed were exposed to a xenon lamp of 100,000 lux for 10 days and then measured their densities of the cyan images in order to determine light fastness of the cyan images. Further, these samples processed were stored at 100° C. for 20 days and then measured their densities of the cyan images in order to determine heat fastness of the cyan images.

The decrease ratios of the maximum density after the test based on the maximum density before the test were shown in Table 1 below.

TABLE 1

| Sample | Coupler | Light Fastness $\left[\frac{D_{max}\text{(before test)} - D_{max}\text{(after test)}}{D_{max}\text{(before test)}}\right] \times 100$ (%) | Heat Fastness $\left[\frac{D_{max}\text{(before test)} - D_{max}\text{(after test)}}{D_{max}\text{(before test)}}\right] \times 100$ (%) |
|---|---|---|---|
| A | Comparison Coupler | 15 | 52 |
| B | (6) (present invention) | 0 | 0 |
| C | (1) (present invention) | 1 | 0 |
| D | (10) (present invention) | 5 | 2 |
| E | (11) (present invention) | 5 | 3 |

From the results shown in Table 1 above it is apparent that the cyan couplers according to the present invention provide color images having extremely good fastness in comparison with Comparison Coupler (a) in which the ballast group is attached on the group represented by Y.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer, said photographic light-sensitive material containing at least one cyan color-forming coupler represented by the following general formula (I):

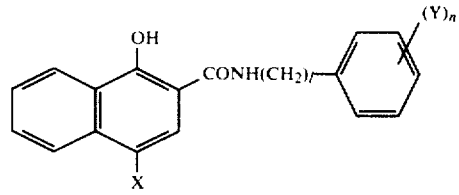

(I)

wherein l represents 0, 1 or 2; X represents a group of the formula (II):

$$-O-(B)_a-(L_1-D)_b-L_2 \quad \text{(II)}$$

capable of being released upon coupling reaction and having at least 6 carbon atoms and wherein in formula (II) $L_1$ represents an alkylene group having 1 to 12 carbon atoms which may be substituted or a phenylene group having 6 to 12 carbon atoms which may be substituted; $L_2$ represents a hydrogen atom, an alkyl group having 8 to 22 carbon atoms which may be substituted or a phenyl group which may be substituted; b represents 0, 1 or 2; D represents a divalent connecting group; B represents a divalent or trivalent group of —CO—, —$CO_2$—, —$SO_2$— or

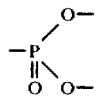

a represents 0 or 1 and when a is 1 and B is a trivalent group another —$(L_1-D)_b-L_2$ group can be present, Y represents RCONH—, RNHCO— or RNHCOHN— wherein R represents a hydrogen atom, a methyl group, an ethyl group or a methyl group substituted with one or more halogen atoms; n represents 1 or 2 and Y may be the same or different when n is 2; and the phenyl group can be substituted with a halogen atom, an alkyl group having 1 to 3 carbon atoms or an alkyl group having 1 to 3 carbon atoms.

2. The color photographic light-sensitive material as claimed in claim 1, wherein said coupling-off group represented by X has an alkali-solubilizing group.

3. The color photographic light-sensitive material as claimed in claim 2, wherein said alkali-solubilizing group is —COOM or —$SO_3M$ wherein M represents a hydrogen atom or an alkali metal atom.

4. The color photographic light-sensitive material as claimed in claim 1, wherein said coupling-off group represented by X is connected to the naphthalene nucleus through the oxygen atom thereof.

5. The color photographic light-sensitive material as claimed in claim 1, wherein said divalent group represented by D is —O—, —NH—, —S—, —NECO—, —CONE—,

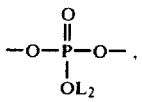

—$CO_2$—, —$NESO_2$— or —$SO_2NE$— wherein E represents a hydrogen atom, an alkyl group having 1 to 8 carbon atoms which may be substituted or a phenyl group which may be substituted.

6. The color photographic light-sensitive material as claimed in claim 1, wherein said cyan coupler is present in a silver halide emulsion layer.

7. The color photographic light-sensitive material as claimed in claim 6, wherein said silver halide emulsion layer is a red-sensitive silver halide emulsion layer.

8. The color photographic light-sensitive material as claimed in claim 7, wherein said photographic material further comprises a blue-sensitive silver halide emulsion layer containing a yellow coupler and a green-sensitive silver halide emulsion layer containing a magenta coupler.

9. A process of forming a cyan dye image which comprises developing an exposed color photographic light-sensitive material as claimed in claim 1 with an aqueous alkaline solution containing a primary aromatic amine developing agent.

* * * * *